US009662264B2

(12) United States Patent
Jacobs

(10) Patent No.: US 9,662,264 B2
(45) Date of Patent: May 30, 2017

(54) AMBULATORY WALKER WITH SEAT

(71) Applicant: James Sumner Jacobs, Sharon, MA (US)

(72) Inventor: James Sumner Jacobs, Sharon, MA (US)

( * ) Notice: Subject to any disclaimer, the term of this patent is extended or adjusted under 35 U.S.C. 154(b) by 0 days.

(21) Appl. No.: 14/705,639

(22) Filed: May 6, 2015

(65) Prior Publication Data

US 2015/0320633 A1 Nov. 12, 2015

Related U.S. Application Data

(60) Provisional application No. 61/990,229, filed on May 8, 2014.

(51) Int. Cl.
*A61H 3/04* (2006.01)
*A61H 3/00* (2006.01)

(52) U.S. Cl.
CPC ..... *A61H 3/04* (2013.01); *A61H 2003/006* (2013.01); *A61H 2003/046* (2013.01); *A61H 2201/0161* (2013.01); *A61H 2201/1633* (2013.01)

(58) Field of Classification Search
CPC ..... A61H 3/04; A61H 3/043; A61H 3/046
See application file for complete search history.

(56) References Cited

U.S. PATENT DOCUMENTS 4,272,071 A 6/1981 Bolton
4,342,465 A 8/1982 Stillings
4,621,804 A 11/1986 Mueller
4,770,410 A 9/1988 Brown
4,953,851 A 9/1990 Sherlock et al.
5,040,556 A 8/1991 Raines
5,058,912 A 10/1991 Harroun
5,133,377 A 7/1992 Truxillo
5,174,590 A 12/1992 Kerley et al.
5,228,708 A 7/1993 Verdugo
5,261,682 A 11/1993 Chuang
5,320,122 A 6/1994 Jacobson, II et al.
5,351,700 A 10/1994 Jones, III et al.
5,353,824 A * 10/1994 Woods ..... A61H 3/00 135/66
5,380,262 A * 1/1995 Austin ..... A61H 3/04 280/647

(Continued)

FOREIGN PATENT DOCUMENTS

CN 2062220 U 9/1990
CN 2812608 Y 6/2006

(Continued)

*Primary Examiner* — Erez Gurari
(74) *Attorney, Agent, or Firm* — Risso I.P.P.C.

(57) ABSTRACT

Described is a walker that is a front entry walker that surrounds the user with a frame on three sides and that includes a fold-down seat when needed. The frame includes a first side frame, a second side frame and a rear frame connected between the first and second side frames. The rear frame includes the seat such that when the seat is in the stowed position, the seat in conjunction with the first and second side frames collectively surround the user on at least three sides. Further, an adjustable arm rest is attached with each of the first and second side frames. Notably, each adjustable arm rest has a forearm support and corresponding brake system.

2 Claims, 7 Drawing Sheets

(56) References Cited

U.S. PATENT DOCUMENTS

| | | | | |
|---|---|---|---|---|
| 5,427,438 | A | 6/1995 | Fochs | |
| 5,476,432 | A | 12/1995 | Dickens | |
| 6,338,493 | B1 | 1/2002 | Wohlgemuth et al. | |
| 6,527,285 | B1 | 3/2003 | Calandro, II | |
| 6,948,727 | B1 | 9/2005 | Bakken | |
| 7,040,637 | B2 | 5/2006 | Owens et al. | |
| 7,108,004 | B2 | 9/2006 | Cowie et al. | |
| 7,669,863 | B2 | 3/2010 | Steiner et al. | |
| 7,735,499 | B1 | 6/2010 | Pennise | |
| 8,511,694 | B2 | 8/2013 | Bradshaw et al. | |
| 8,584,689 | B2 | 11/2013 | Catton | |
| 8,596,658 | B1 | 12/2013 | Dashew et al. | |
| 2003/0070702 | A1* | 4/2003 | Ownes | A61H 3/00 135/74 |
| 2005/0156395 | A1 | 7/2005 | Bohn | |
| 2005/0183759 | A1 | 8/2005 | Wolfe | |
| 2009/0224499 | A1* | 9/2009 | Dashew | A61H 3/04 280/87.05 |
| 2013/0082454 | A1 | 4/2013 | Slomp | |
| 2013/0168931 | A1 | 7/2013 | Baraitaru | |
| 2014/0265188 | A1* | 9/2014 | Chang | F16D 59/02 280/47.4 |

FOREIGN PATENT DOCUMENTS

| | | | |
|---|---|---|---|
| CN | 201375647 | Y | 1/2010 |
| CN | 201384674 | Y | 1/2010 |
| CN | 201676135 | U | 12/2010 |
| WO | WO2008075209 | A1 | 6/2008 |

* cited by examiner

100

100

100

AMBULATORY WALKER WITH SEAT

CROSS-REFERENCE TO RELATED APPLICATIONS

This is a non-provisional application of U.S. Provisional Application No. 61/990,229, filed on May 8, 2014, and entitled, "Walker."

BACKGROUND OF THE INVENTION (1) Field of Invention

The present invention relates to a walker and, more particularly, to a walker that is a front entry walker that surrounds the user with a sturdy frame on three sides and that includes a fold-down seat when needed.

(2) Description of Related Art

Ambulatory walkers have long been known in the art. Traditional walkers are rear-entry walkers with waste-high handles that are held by a user and pushed forward as the user walks. While operable, such traditional walkers do not adequately surround the user nor support the user's weight when walking. Importantly, in the event that a user needs to immediately sit or otherwise rest, such walkers provide no such seat.

Thus, a continuing need exists for an improved walker that is a front entry walker that surrounds the user with a sturdy frame on three sides and that includes a fold-down seat when needed.

SUMMARY OF INVENTION

Described is an ambulatory walker with a seat. The walker includes a frame formed to surround a user on at least three sides. A seat is included that is pivotally connected with the frame to pivot between a deployed position where a user can sit upon the seat and a stowed position to allow a user to walk with the walker.

In another aspect, the frame includes a first side frame, a second side frame and a rear frame connected between the first and second side frames. The rear frame includes the seat such that when the seat is in the stowed position, the seat in conjunction with the first and second side frames collectively surround the user on at least three sides.

In yet another aspect, an adjustable arm rest is attached with each of the first and second side frames. Each adjustable arm rest includes a forearm support.

In yet another aspect, a front wheel and rear wheel are connected with each of the first and second side frames. Further, the front wheels are swivelly connected with each of the first and second side frames.

In another aspect, a brake system is connected with the rear wheels. The brake system includes brake handles attached with each of the adjustable arm rests. The brake handles are operably connected with the rear wheels to allow a user to selectively operate the brake system.

In another aspect, the seat further comprises two halves that are hingedly connected with one another.

Further, the frame is convertible between an extended position and a collapsed position, wherein when in the collapsed position, the seat is folded in half to draw the first and second sides toward one another.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
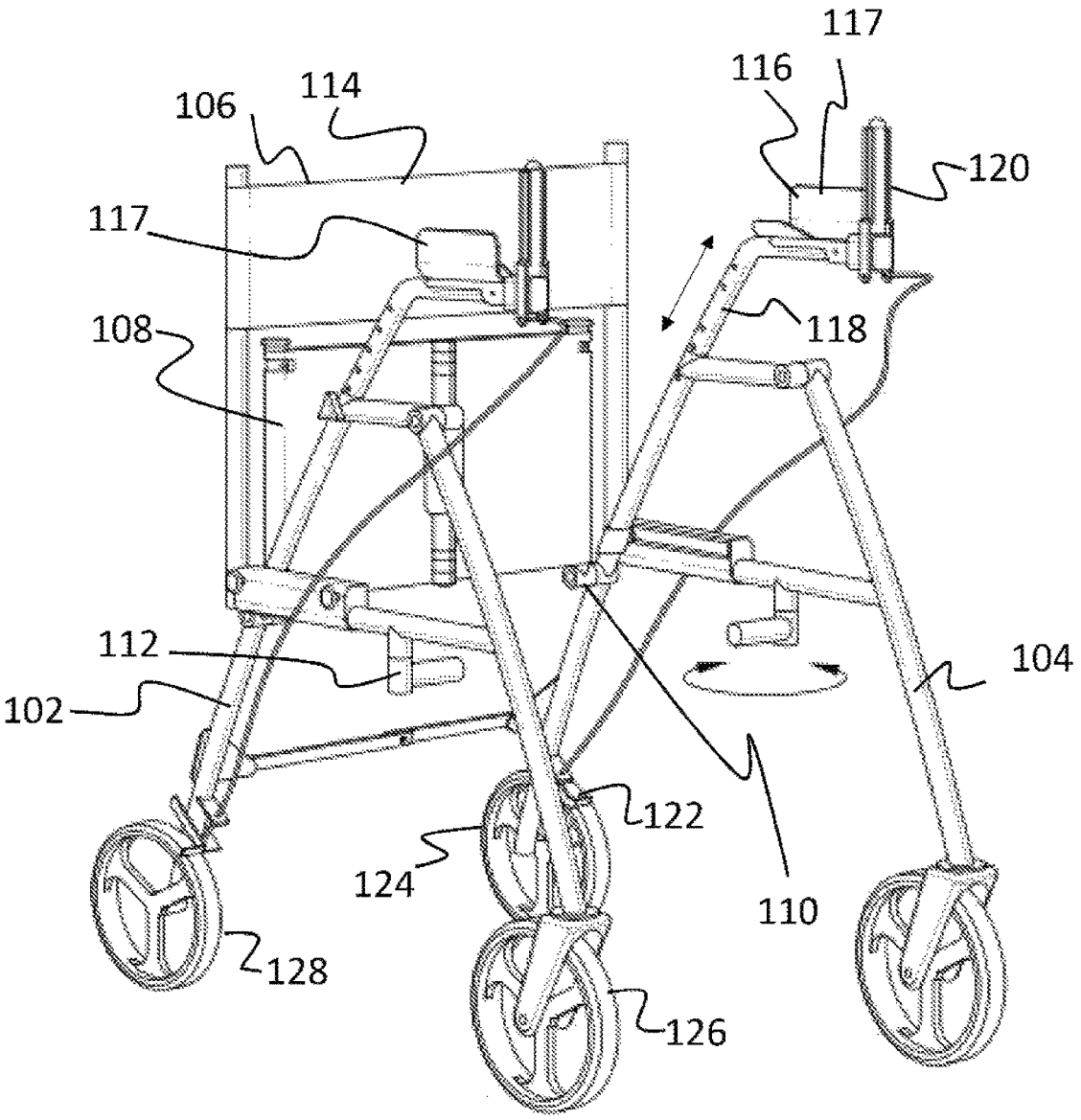
FIG. 1 is an illustration of an ambulatory walker with a seat according to the principles of the present invention, depicting the seat in a stowed position.

The present invention relates to a walker and, more particularly, to a walker that is a front entry walker that surrounds the user with a sturdy frame on three sides and that includes a fold-down seat when needed. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of"step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction.

Instead, they are used to reflect relative locations and/or directions between various portions of an object.

(1) Description

As noted above and as illustrated in FIG. 1, the present invention is directed to an ambulatory walker 100 that is a front entry walker with a frame (e.g., metal, carbon fiber, etc.) that surrounds the user on three sides. As a non-limiting example, the frame includes a first side frame 102, a second side frame 104, and a rear frame 106 connected between the first 102 and second 104 side frames. In one aspect and as shown, the first 102 and second 104 side frames are formed of a rigid material (e.g., metal, aluminum tubing, carbon fiber, etc.), whereas the rear frame 106 is collectively formed of a backrest 114 and a seat 108. Thus, although each of the frames can in one aspect be formed of rigid metal, the invention is not intended to be limited thereto as the frame can be formed of a collection of components and materials to collectively surround the user on at least three sides.

It should be noted that although the first 102, second 104, and rear 106 frames are depicted as being attached at 90 degree angles with respect to one another, the invention is not intended to be limited thereto as the relevant sides and rear can be formed in a continuous and semi-circular shape, or any other suitable shape so long as it surrounds the user on at least three sides.

Figure 2:
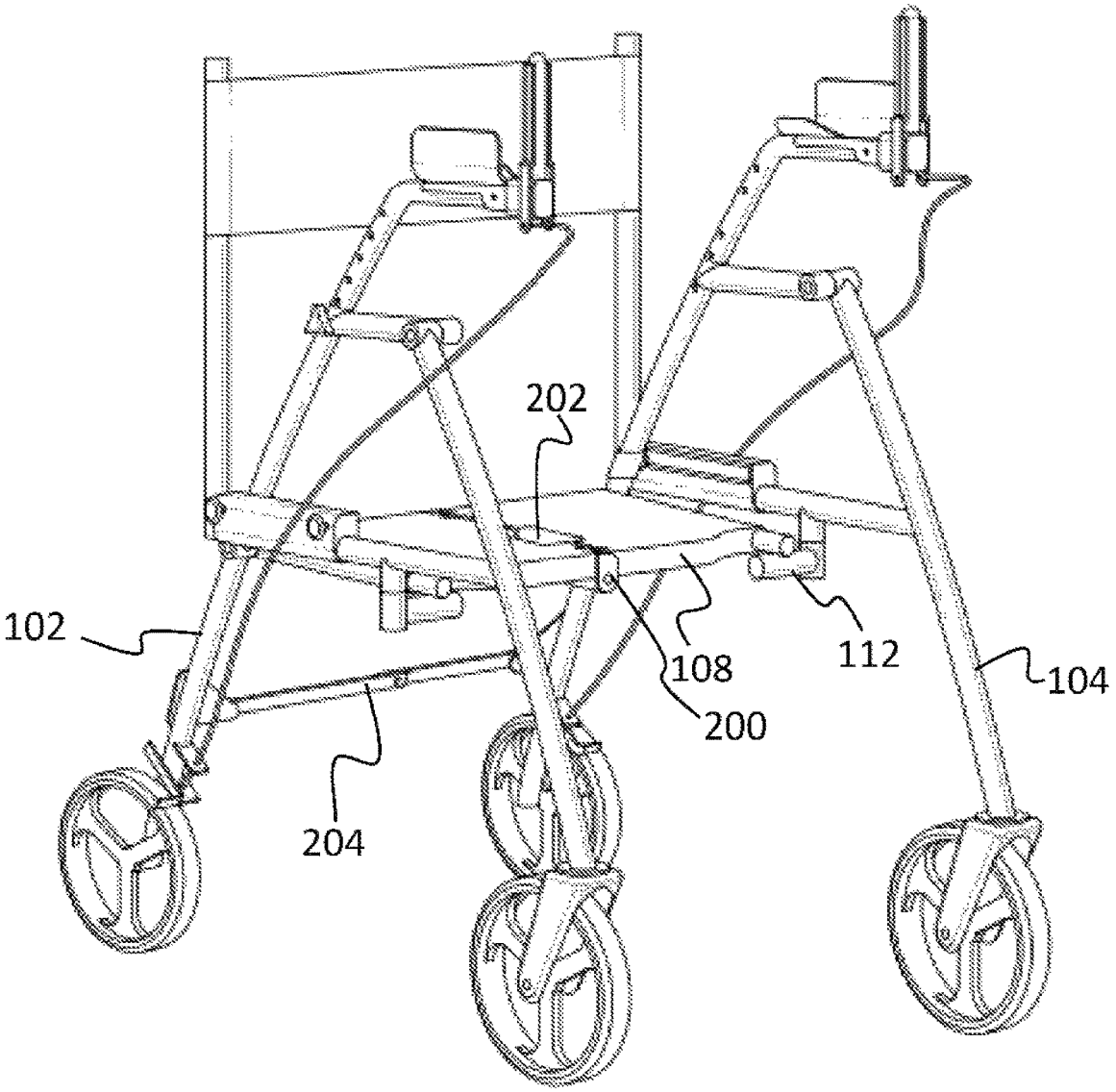
FIG. 2 is an illustration of the ambulatory walker with a seat according to the principles of the present invention, depicting the seat in a deployed position.

Pivotally attached with the frame (at any suitable location) is a seat 108. As a non-limiting example, the seat 108 is pivotally attached with and between the first 102 and second 104 side frames using a pair of rotating hinges 110. The seat 108 pivots between a stowed position (as depicted in FIG. 1) and a deployed position (as shown in FIG. 2). Seat rest supports 112 are included to support the seat 108 and a user's body weight when the seat 108 is in the deployed position. In one aspect, the seat rest supports 112 are metal tubes (or any other component) that attach with the frame and are adapted to support the seat 108. The seat rest supports 112 can be fixed or, as depicted, rotatably attached with the frame such that they can be selectively rotated into a position such that they are operable for catching and supporting the seat 108. Alternatively and in this aspect, the seat rests supports 112 can be rotated out of position such that they do not interfere with a user walking within the walker 100. However and as noted above, in another aspect, the seat rest supports 112 can be fixed in a position to receive and support the seat 108. In another aspect (not depicted), the seat rest supports 112 can be tabs protruding from the seat 108 that catch and rest upon a frame member when in the deployed position.

Figure 3:
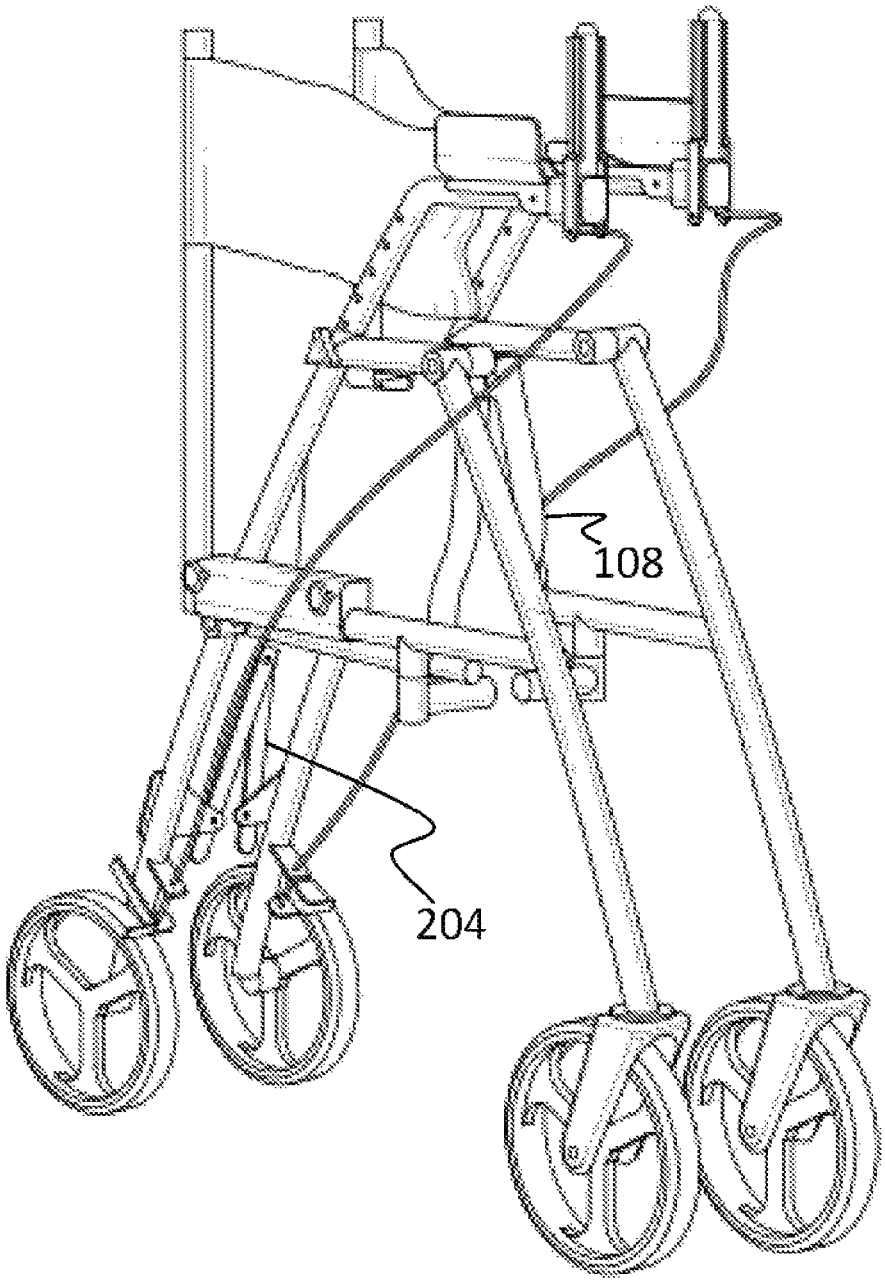
FIG. 3 is an illustration of an ambulatory walker with a seat according to the principles of the present invention, depicting the walker in a collapsed position for storage or transport.

The rear frame 106 includes a back rest 114. The back rest 114 spans and is connected between the first 102 and second 104 side frames. The back rest 114 is desirably foldable such that when the walker 100 is in the collapsed position (as shown in FIG. 3), the back rest 114 folds or otherwise allows for such collapsing of the walker 100. The back rest 114 is formed of any suitable material or in any suitable manner to provide for folding. As a non-limiting example, the back rest 114 is formed of a fabric or cloth material.

To further encourage a more upright and balanced walking position, the walker 100 includes adjustable arm rests 116 (with a forearm support 117). The adjustable arm rests 116 further include any suitable mechanism or device that allows a user to selectively alter the height of the arm rests 116. As a non-limiting example, each adjustable arm rest 116 is attached with, for example, a tube member 118 that allows a user to selectively telescope the tube member 118 within the first 102 or second 104 frames. A push pin or other similar device can be used to selectively lock the tube member 118 at the desired position and, thereby, adjust the height of the arm rests 116. The adjustable arm rests 116 encourage the upright walking position by forcing the user to place his forearms in the forearm supports 117 parallel to the ground in an upright position in order to grasp the attached brake handles 120 to properly operate the passive braking system with both hands. Current walkers are not height-adjustable and allow or even encourage the user to lean over (whereas the walker 100 and its arm rests 116 assists the user to stand erect).

As noted above, the walker 100 includes a brake system. The brake system is any suitable system that allows a user to selectively brake the walker 100. As a non-limiting example, the brake system includes at least one brake handle 120, which is connected (via a cable or other suitable device) with a brake apparatus (e.g., lever 122) that is selectively engageable (or dis-engageable as discussed below) with a wheel 124. Although not required, the brake system desirably includes a pair of brake handles 120, each of which is independently operable and connected with a brake apparatus. Thus, in this aspect, the walker 100 allows the user to brake the walker 100 using one or both hands.

In another aspect, the brake system is designed such that it is passive or "dead man." In other words, the brakes are always on (i.e., braking), unless they are engaged by the user. For example, the brake apparatus (e.g., lever 122) is biased (via a spring or any other mechanism or device) to engage with the wheels. Thus, in this aspect, the brake apparatus at rest is locking or braking the wheels. As the user pulls the brake handles 120, the brake apparatus disengages from the wheels, allowing the walker 100 to roll. As a non-limiting example, as a user pulls the brake handles 120, the cable pulls the levers 122 off of the wheels. An advantage of such a passive braking system is that in order to actually move in any direction, the user is forced into a safer upright position as it is necessary for the user to place the forearms in the appropriate position (forearm support 117) to use the brake handles 120.

In another aspect, the brake handles 120 are rotatably connected with the frame (via a rotating hinge). Thus, in this aspect, the handles 120 can be rotated into a horizontal position and locked in such a position via locking pin or other suitable device.

For stability, the walker 100 includes a pair of front wheels 126 and a pair of rear wheels 128. In one aspect, all of the wheels are connected with a swivel device to enable the user to move in any direction immediately. In another aspect and as depicted, only the front wheels 126 are allowed to swivel, whereas the rear wheels 128 rotation is affixed in a forward-reverse direction.

As noted above and as shown in FIG. 2, the seat 108 is pivotally connected with the frame such that it can be folded down when needed. In the example depicted in FIG. 2, the seat 108 rests upon the seat rest supports 112 to securely hold the seat 108 in the deployed position.

For storage or transport, the walker 100 can be easily folded into a collapsed position (as shown in FIG. 3) from an extended position (as shown in FIG. 2). In order to fold, the seat 108 can be either foldable or collapsible. Thus, in one aspect, the seat 108 includes a sturdy frame with a fabric center. In another aspect and as depicted in FIG. 2, the seat 108 is formed of a rigid material (e.g., plastic, etc.) and includes at least two halves that are hingedly connected with one another (via a central hinge 200). This, in this aspect, the walker 100 collapses by, for example, grabbing a handle member 202 formed in the intersection of the two halves. By lifting up on the handle member 202, the seat 108 folds in half to pull the first 102 and second 104 sides toward one another and into the collapsed position. Although not required, the walker 100 also desirably includes a rear support member 204 that is foldable via a hinge or other suitable device. Thus, the rear support member 204 is also folded during the transition into the collapsed position, as shown in FIG. 3.

Figure 4:
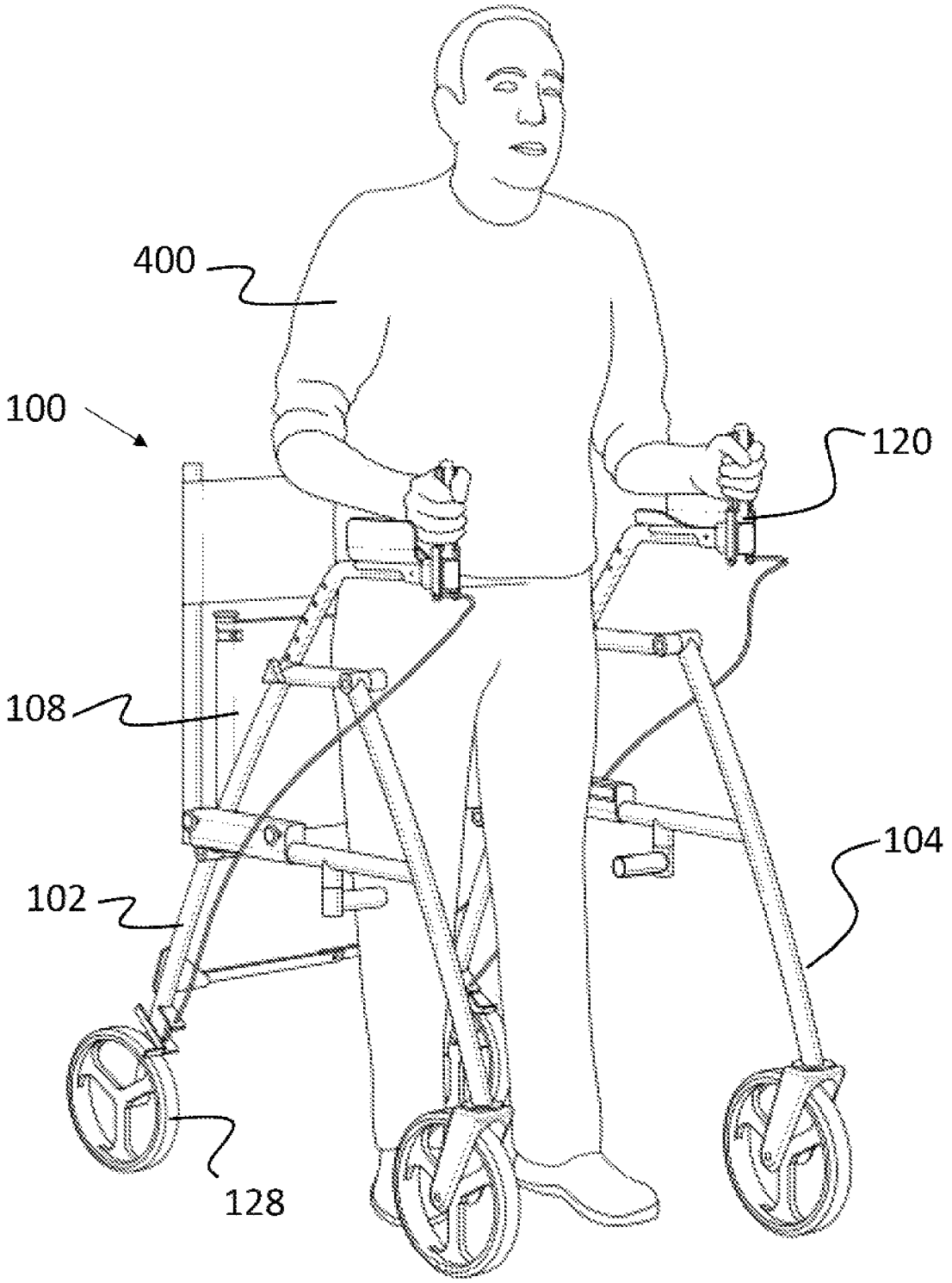
FIG. 4 is an illustration of an ambulatory walker with a seat according to the principles of the present invention, depicting the seat in a stowed position and a user walking with the walker.

For further understanding, FIG. 4 illustrates the seat 108 in a stowed position, with a user 400 walking with the walker 100. Because it is a front entry walker 100, the walker 100 surrounds the user 400 with a sturdy frame on the sides. The surrounding frame in conjunction with the large wheels 128 and brake handles 120 in the front minimize contact with others and prevent accidental falls. Contact is especially avoided by providing a barrier against people and obstacles behind and to the side of the user, where the user's vision is not focused.

In another aspect, a harness can optionally be included to further assist the most fragile users in staying upright and resisting falls if contact occurs. For example, the harness can be a cloth harness that connects with the user 400 and the first 102 and second 104 side frames.

Figure 5:
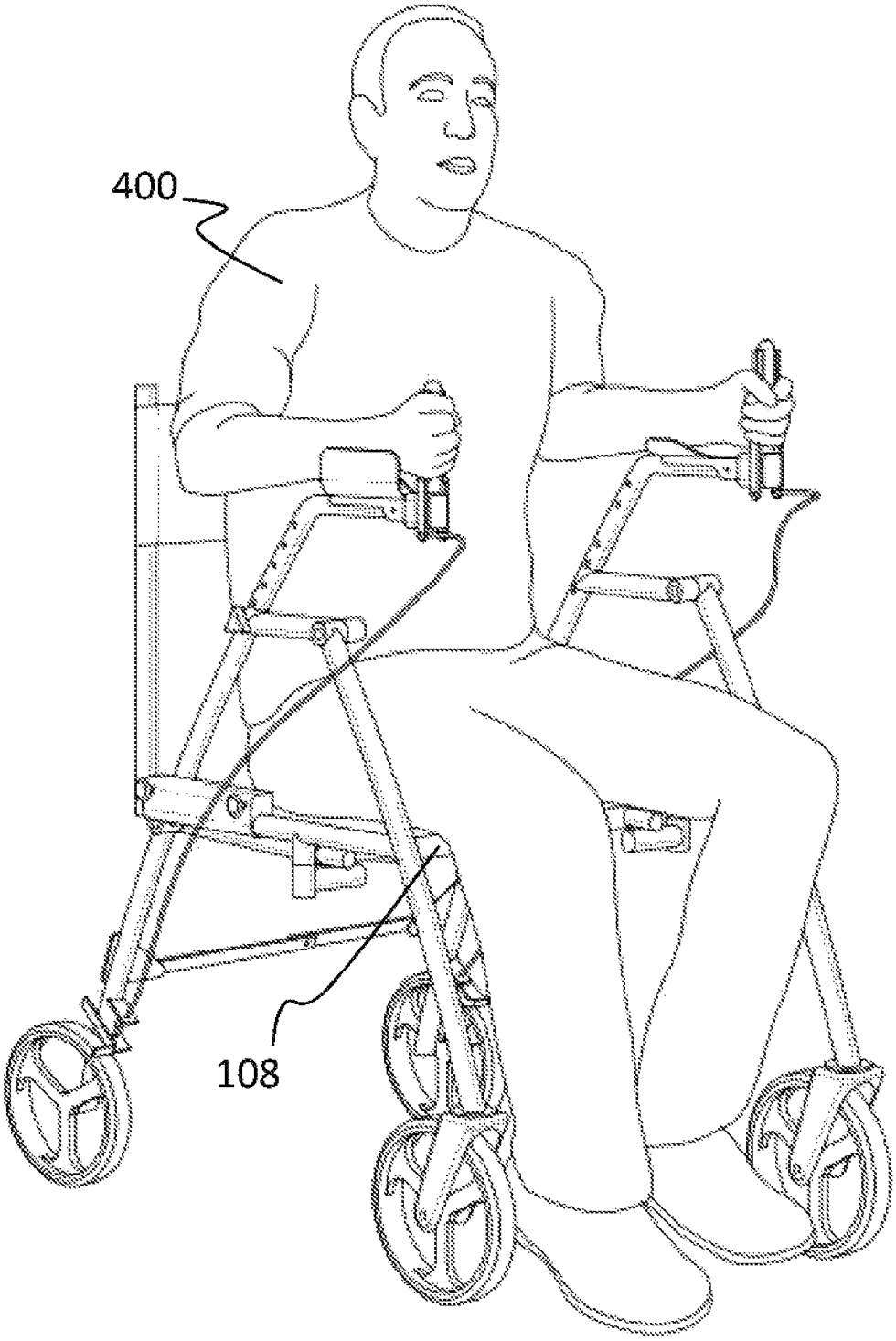
FIG. 5 is an illustration of an ambulatory walker with a seat according to the principles of the present invention, depicting the seat in a deployed position with a user sitting on the seat.

Also as noted above and as shown in FIG. 5, the seat 108 is selectively positionable into a deployed position. Thus and as depicted, a user 400 can safely sit upon the seat 108 when needed. When seated, the user 400 can rest or continue to roll around as desired and use the brake system if needed or desired. For example, the walker 100 can operate as a seated walker, which the user 400 can operate from a seated position by using her feet, while still able to operate the brakes.

Figure 6:
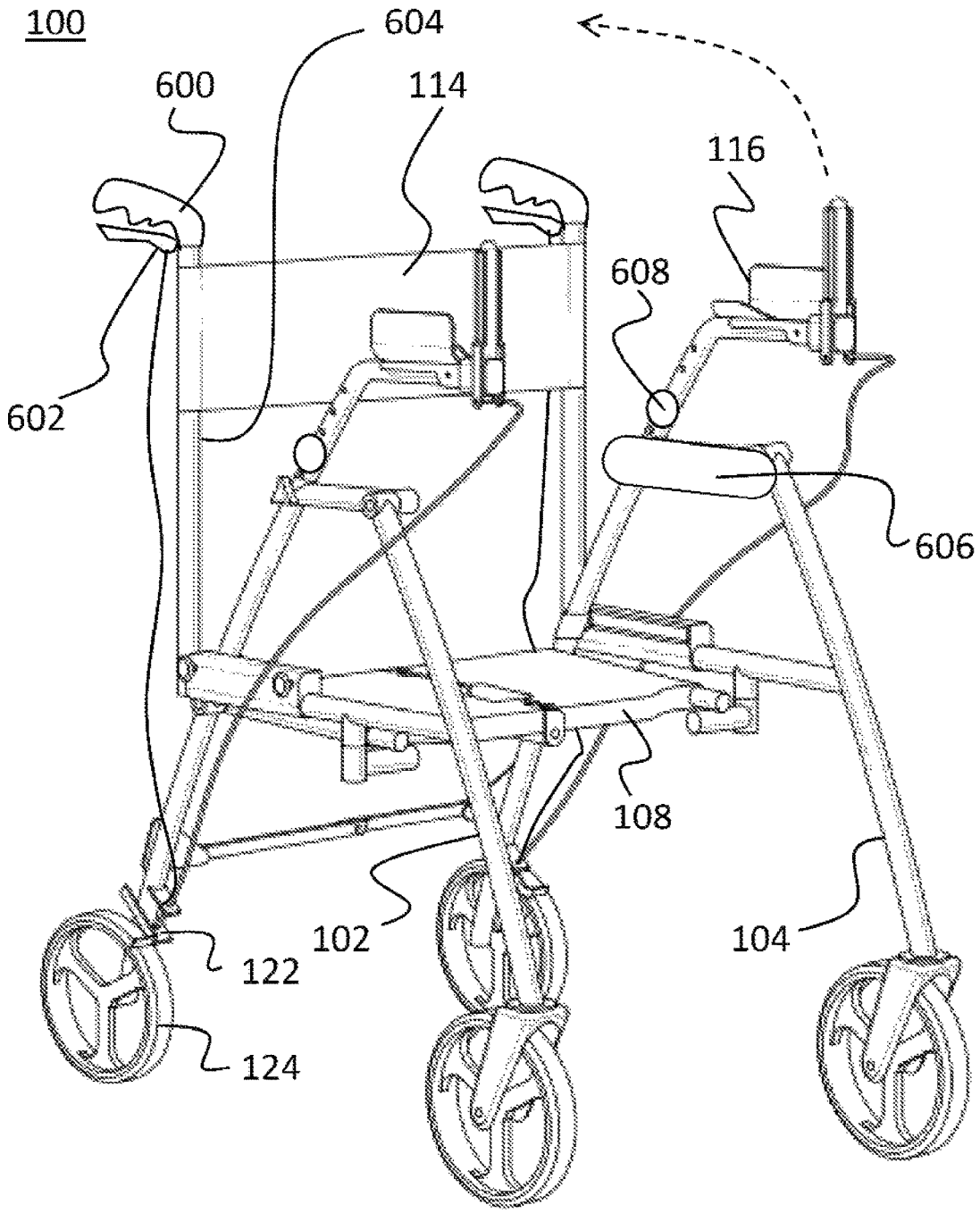
FIG. 6 is an illustration of an ambulatory walker with a seat according to the principles of the present invention.

In another aspect and as shown in FIG. 6, rear pushing handles 600 and a rear braking system can be optionally included. The rear pushing handles 600 allow an assistant or caregiver to push the user around when seated upon the seat 108. Additionally, the rear braking system includes brake handles 602 which are connected (via a cable or other suitable device) with the brake apparatus (e.g., lever 122) that is selectively engageable with a wheel 124. Thus, in this aspect, the walker 100 includes a redundant braking system, one that can be selectively operated by the user and another rear braking system that can be operated by an assistant or caregiver. It should also be understood that if the patient operated braking system (via the brake handles 120) is passive as described above, then the rear braking system can also be formed to be passive such that a user selectively dis-engages the brake apparatus from the wheel 124.

Although not depicted, it should be understood that additional accessories can be easily incorporated into the walker 100. For example, optional foot rests and arm cushions can be added. For example, if the arm rests 116 were removed, a separate arm cushion can be easily slid into each of the first 102 and second 104 frames. Thus in this aspect, one can easily envision the walker 100 being converted into a transport wheelchair or the like.

In another aspect, such arm cushions can fold down to a horizontal surface from the frame (e.g., pipe) that has adjustment holes or locks in it. As a non-limiting example, arm cushions can be pivotally attached with the vertical frame member 604 that holds the backrest 114. Thus, in this aspect, they arm cushions would swing down to the horizontal position for use, or rotate up against the vertical frame member 604 and out of the way. In another aspect, arm cushions 606 can be permanently attached with the frame (as illustrated on one side).

In yet another aspect, the arm rests 116 can be pivotally attached (via, for example, a hinge 608) with the first 102 and second 104 side frames such that they can be swiveled up toward a user who is pushing the walker 100. In this aspect, the brake controls are provided to the pusher to allow the person pushing the walker control the brakes (in addition to or instead of the rear brakes as described above).

Figure 7A:
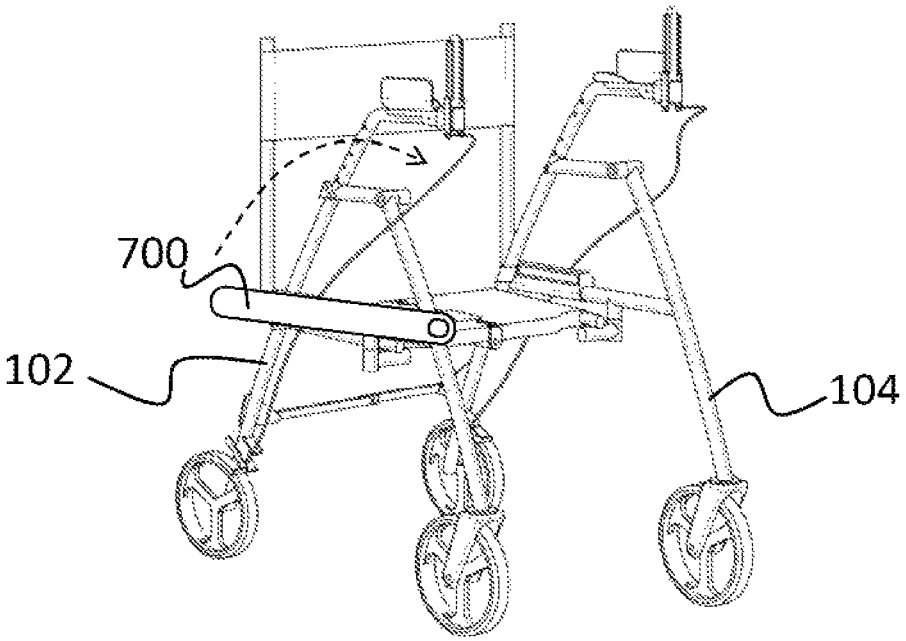
FIG. 7A is an illustration of an ambulatory walker according to the principles of the present invention.
Figure 7B:
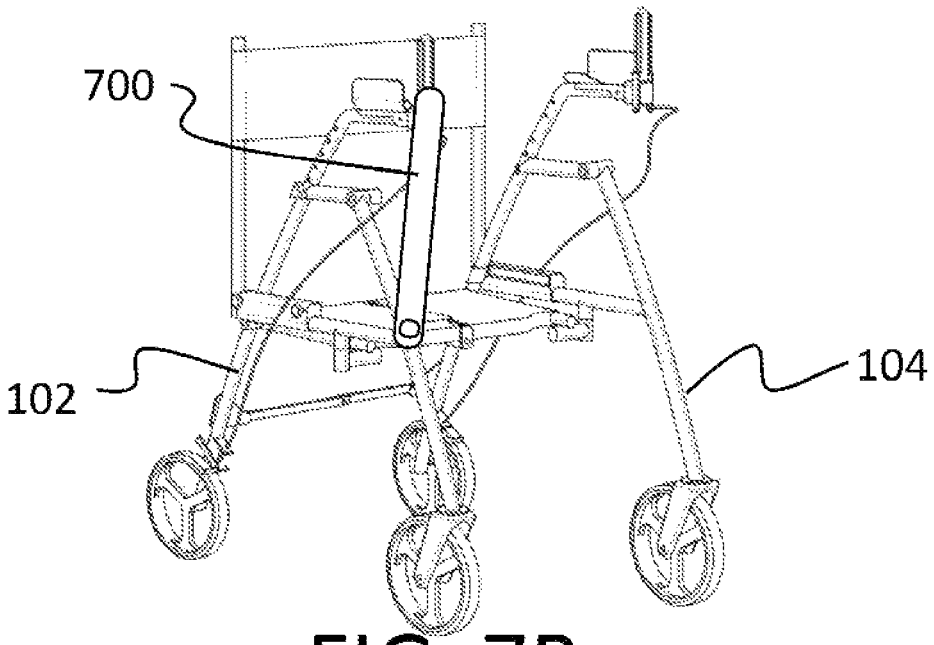
FIG. 7B is an illustration of an ambulatory walker according to the principles of the present invention.

In yet another aspect, smaller and lower arm rests (than those depicted) could swivel in from the sides of the walker 100. In another aspect and as shown in FIGS. 7A and 7B, pull-up poles 700 can also be included. FIG. 7A depicts a pull-up pole 700 in a stored position, whereas FIG. 7B depicts the pull-up pole 700 are rotated out for use. It should be understood that FIGS. 7A and 7B depict a single pull-up pole 700 for illustrative purpose only and that the invention is not intended to be limited thereto as one or more pull-up poles 700 can be affixed with both the first 102 and second 104 side frames. The pull-up poles 700, for example, can be formed to rest parallel to the arm rests 116 and can be rotated upward (e.g., 90 degrees) where they can then be fixed in place (via any suitable locking mechanism (e.g., push pin, etc.)). The user can then grab onto the pull-up poles 700 to pull herself up from a seated position. This could be an accessory, for example, that attaches on the outside of the side frames. Other optional accessories include a footrest and a basket.

In yet another aspect, the walker 100 can convertible between a few configurations such that it is operable as a hybrid walker. In one configuration, the walker is a surround walker device as described above that supports a user walk walking. In another configuration, the walker can be partially collapsed to an intermediate lockable position to provide a rolling walker with a reduced profile. For example and as described above with respect to FIG. 3, the walker 100 is collapsed by pulling up on a handle member 202 formed in the seat 108. An intermediate catch or lock can also be included such that as the seat is folded, the seat 108 locks halfway between the open position of FIG. 2 and the collapsed position of FIG. 3. Thus, in this aspect, the overall width of the walker 100 is reduced (as compared to the position depicted in FIG. 2), allowing a user to easily walk behind the walker 100 through doorways and other confined spaces. In another configuration, the walker 100 serves as a pull up device in that it is operable for assisting a user in getting up from a chair due to the passive (dead man) brakes and by pulling up on the accessory pull-up poles (as depicted in FIGS. 7A and 7B). In another configuration, the walker 100 serves as a transport wheelchair that can be pushed from behind with the rear brakes operated by a pusher from behind. Finally and in yet another configuration, the walker 100 serves as a seated and self-propelled walker, allowing a user to user their own feet to roll along a surface.

Finally, it should be understood that the specific examples described and illustrated are provided as non-limiting examples of suitable aspects; however, the invention is not intended to be limited thereto as it can be modified as needed and is to be accorded the widest scope consistent with the principles and novel features disclosed herein.

What is claimed is:

1. An ambulatory walker with a seat, comprising:

a frame, the frame formed to surround a user on at least three sides, wherein the frame includes a first side frame and a second side frame;

a seat, the seat being pivotally connected with the frame to pivot between a deployed position where a user can sit upon the seat and a stowed position to allow a user to walk with the walker; and an adjustable arm rest attached with each of the first and second side frames, each adjustable arm rest having a forearm support and being adjustable to a height such that the forearm supports are at a height sufficient to receive the user's forearms when in an erect upright walking position;

wherein the frame includes a rear frame connected between the first and second side frames, and wherein the rear frame includes the seat such that when the seat is in the stowed position, the seat in conjunction with the first and second side frames collectively surround the user on at least three sides;

a front wheel and rear wheel connected with each of the first and second side frames;

wherein the front wheels are swivelly connected with each of the first and second side frames;

a brake system connected with the rear wheels, the brake system having brake handles attached with each of the adjustable arm rests such that the brake handles project upwardly and away from a ground surface, the brake handles being operably connected with the rear wheels to allow a user to selectively operate the brake system; and wherein the seat is pivotally connected with the frame along a seat pivot axis, and wherein the seat further comprises two halves that are hingedly connected with one another along a seat fold axis that resides between each of the first and second sides and is perpendicular to the seat pivot axis.

2. The ambulatory walker with a seat as set forth in claim 1, wherein the frame is convertible between an extended position and a collapsed position, wherein when in the collapsed position, the seat is folded in half along the seat fold axis to draw the first and second sides toward one another.

* * * * *